US006361679B1

(12) United States Patent
Kikkawa et al.

(10) Patent No.: US 6,361,679 B1
(45) Date of Patent: Mar. 26, 2002

(54) PROCESS FOR PRODUCING HIGH-PURITY NITROGEN TRIFLUORIDE GAS

(75) Inventors: Akio Kikkawa; Tatsuma Morokuma; Hiromi Hayashida, all of Yamaguchi (JP)

(73) Assignee: Mitsui Chemicals, Inc. (JP)

( * ) Notice: Subject to any disclaimer, the term of this patent is extended or adjusted under 35 U.S.C. 154(b) by 0 days.

(21) Appl. No.: 09/497,342

(22) Filed: Feb. 3, 2000

(30) Foreign Application Priority Data

Feb. 10, 1999 (JP) ..... 11-032476

(51) Int. Cl.[7] ..... C25B 1/00
(52) U.S. Cl. ..... 205/359; 205/360
(58) Field of Search ..... 205/359, 360

(56) References Cited

U.S. PATENT DOCUMENTS 3,235,474 A * 2/1966 Tompkins, Jr. et al. ..... 205/360
4,804,447 A 2/1989 Sartori
5,084,156 A * 1/1992 Iwanaga et al. ..... 205/359
5,085,752 A * 2/1992 Iwanaga et al. ..... 205/359

FOREIGN PATENT DOCUMENTS

JP 3236486 A2 10/1991

* cited by examiner

*Primary Examiner*—Arun S. Phasge
(74) *Attorney, Agent, or Firm*—Burns, Doane, Swecker & Mathis, LLP

(57) ABSTRACT

A process for producing high-purity nitrogen trifluoride gas by molten salt electrolysis using a nickel electrode and ammonium hydrogenfluoride as an electrolyte, wherein carbon element constituting impurity gases entrained in a crude gas, among impurities in the nickel electrode as an anode is controlled to an amount of 400 wt ppm or less. The process allows high-purity nitrogen trifluoride gas to be produced with a purity of 4N or higher.

6 Claims, 2 Drawing Sheets

PROCESS FOR PRODUCING HIGH-PURITY NITROGEN TRIFLUORIDE GAS

BACKGROUND OF THE INVENTION

1. Field of the Invention

This invention relates to a process for producing high-purity nitrogen trifluoride ($NF_3$) gas. In particular, it relates to a production process whereby high-purity nitrogen trifluoride gas can be industrially provided with a low cost.

2. Description of the Related Art

Nitrogen trifluoride gas has increasingly become important in applications related to an electronic material, particularly as a gas for dry-etching during manufacturing a semiconductor device, a gas for dry-cleaning of a plasma CVD apparatus or a gas for cleaning a batchwise production apparatus for a wafer type device in a liquid crystal display using TFT, and thus its production quantity has been considerably increased. It has been needed to provide higher-purity $NF_3$ gas for the above applications There have been proposed a variety of processes for producing $NF_3$ via molten salt electrolysis. For example, a process using nickel as an anode is industrially common because it produces few impurities such as $CF_4$.

Acid ammonium fluoride (ammonium hydrogenfluoride) is used as a material for the molten salt electrolysis. Ammonium hydrogenfluoride commercially available as a reagent contains ammonium hexafluorosilicate as an impurity in a significant amount. Thus, because of a lower amount of impurities, it is preferable to use ammonium hydrogenfluoride prepared from hydrofluoric acid and ammonia as described in JP-A 4-56789. However, since recent technical improvement increasingly requires higher-purity $NF_3$ gas, it has been needed to provide the product gas with a higher purity.

Such a higher-purity gas may be obtained by purifying a crude gas produced after the molten salt electrolysis (hereinafter, referred to as a "crude gas"); for example, by introducing it along with a carrier gas into a purifier or purifiers in which adsorption by, e.g., zeolite, activated alumina or silica gel, chemical cleaning, plasma decomposition, low-temperature separation and/or liquefied-gas rectification occur.

The crude gas contains, other than a carrier gas and moisture ($H_2O$), a significant amount of various impurities such as dinitrogen monoxide ($N_2O$), carbon dioxide ($CO_2$), carbon monoxide (CO), dinitrogen difluoride ($N_2F_2$), oxygen difluoride ($F_2O$), sulfur hexafluoride ($SF_6$) and carbon tetrafluoride ($CF_4$). Thus, the crude gas must be purified with the above purifier or purifiers.

When using the purifiers, it is necessary to control their performance depending on the levels of the impurities or their variation. For example, for an apparatus where adsorption occurs, various parameters must be adjusted by, e.g., altering an adsorption rate or a frequency of replacing or regenerating an adsorbent. Thus, it may require additional labor and complicated quality control such as frequent checking a purified product gas for its purity variation, leading to increase in a cost.

For industrially producing $NF_3$ gas with a purity of 4N (99.99 vol %), 5N (99.999 vol %) or higher, controlling an impurity level in a crude gas, i.e., an impurity content, is quite important. There are instrumental and economical restrictions in purifying a crude gas containing a significant amount of impurities to provide a high purity gas. It is, therefore, substantially difficult to economically produce a high purity gas.

SUMMARY OF THE INVENTION

An object of this invention is to provide a process for conveniently producing high-purity nitrogen trifluoride gas with a purity of 4N or higher using a conventional purification method or apparatus by reducing an impurity content in a crude gas.

The present inventors have intensely investigated causes for generation of impurities to solve the above problems, and have found that impurities in nitrogen trifluoride gas are mainly derived from minor components contained in Ni used as an electrode and thus the impurity content can be controlled by using an electrode with a given purity to considerably reduce impurity gases and to produce high-purity $NF_3$ gas.

This invention provides a process for producing high-purity nitrogen trifluoride gas by molten salt electrolysis using a nickel electrode and ammonium hydrogenfluoride as an electrolyte, wherein carbon constituting impurity gases entrained in a crude gas, among impurities in the nickel electrode as an anode is controlled to an amount of 400 wt ppm or less, preferably 200 wt ppm or less, more preferably 100 wt ppm or less.

The process of this invention is an extremely simple process where molten salt electrolysis is conducted using an electrode, particularly an anode, made of nickel with a given purity to industrially produce high-purity nitrogen trifluoride gas with an economical cost.

Controlling the impurity content in the nickel electrode allows high-purity nitrogen trifluoride gas which cannot be provided by the prior art, to be practically produced.

DETAILED DESCRIPTION OF THE PREFERRED EMBODIMENTS

Nickel used as an electrode material in $NF_3$ production generally contains a variety of impurity elements.

In JP-A 8-134675, the assignee of this invention has disclosed a process for producing high-purity $NF_3$ gas wherein a sulfur content in a nickel electrode is controlled to 20 wt ppm or less to reduce $SF_6$ generation in a crude gas. In addition, in JP-A 8-120475, there are disclosures of a process wherein high-purity hydrofluoric acid and gaseous ammonia as materials for preparing ammonium hydrogenfluoride as well as a nickel electrode with a purity of 98.5 wt % or higher are used for molten salt electrolysis.

After further investigation, the inventors have found that carbon element among the impurities in the nickel may be controlled to an amount of 400 wt ppm or less, preferably 200 wt ppm, more preferably 100 wt ppm or less, to reduce impurity gases derived from this element.

Nickel for an anode preferably has a purity of 98.5 wt % or higher. Nickel with a purity less than 98.5 wt % may make it difficult to produce high-purity $NF_3$ gas with a purity of 4N or higher. As disclosed in JP-A 8-134675, it is, of course, desirable to control a sulfur content in the nickel to 20 wt ppm or less for reducing $SF_6$ gas. In the present invention, the content of other impurities such as B, Si, P, As, Mo, Ge and W in the nickel electrode is also preferably controlled to an amount of 400 wt ppm or less in terms of sum with C.

From the economical and industrial viewpoints, ammonium hydrogenfluoride is preferably prepared from, but not limited to, hydrogen fluoride and ammonia gases. In particular, it is preferable to use ammonium hydrogenfluoride prepared by reacting hydrogen fluoride gas with a purity of 99.8 wt % or higher with ammonia gas with a purity of 99.5 wt % or higher for reducing impurity gases derived from the starting materials, as disclosed in JP-A 8-120475. Hydrogen fluoride and ammonia gases with the above purities may be prepared by gasifying industrial grade anhydrous hydrofluoric acid and liquid ammonia, respectively.

A preferable embodiment of this invention will be described with reference to the drawings.

Figure 1:
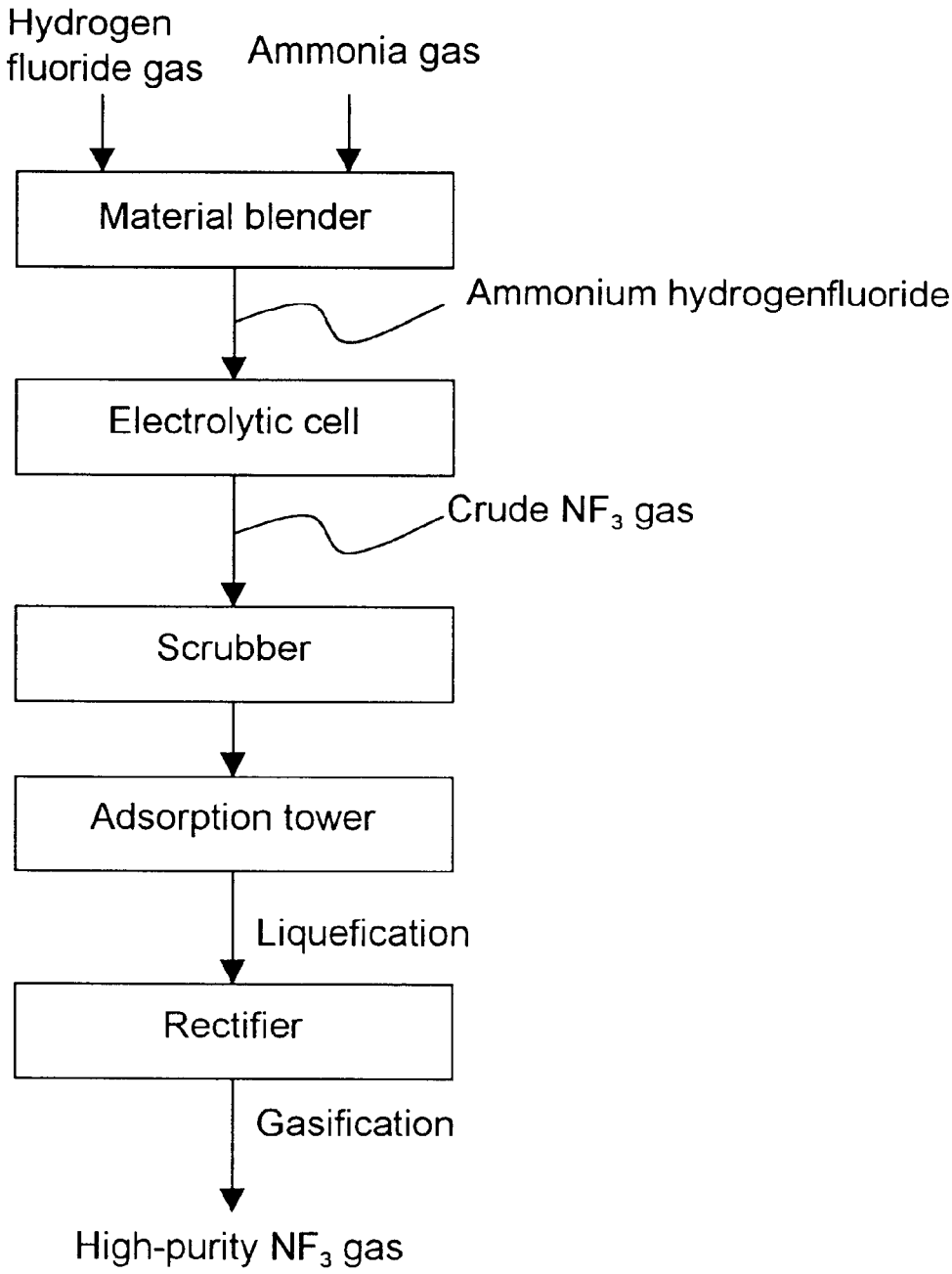
FIG. 1 shows an example of a production flow sheet suitable for the process of this invention.

FIG. 1 shows a flow sheet of a preferable production process according to this invention, where given amounts of hydrogen fluoride (HF) and ammonia ($NH_3$) gases are supplied to a material blender to generate ammonium hydrogenfluoride which is then introduced into an electrolytic cell in which $NF_3$ gas is generated in the anode by molten salt electrolysis. It is preferable to seal the material blender with a suitable amount of inert gas such as nitrogen, argon and helium gases for avoiding influence of the ambient air.

Since the reaction between hydrogen fluoride and ammonia gases is extremely quick, vigorous agitation is not necessary and there are no restrictions for the material blender as long as it allows hydrogen fluoride and ammonia gases to adequately contact with each other and does not react with these gases. A metal blender whose inner surface is lined with a fluororesin such as ETFE and PFA is preferable. Hydrogen fluoride and ammonia gases are preferably reacted in an $HF/NH_4F$ molar ratio of 1.5 to 2.0.

Figure 2:
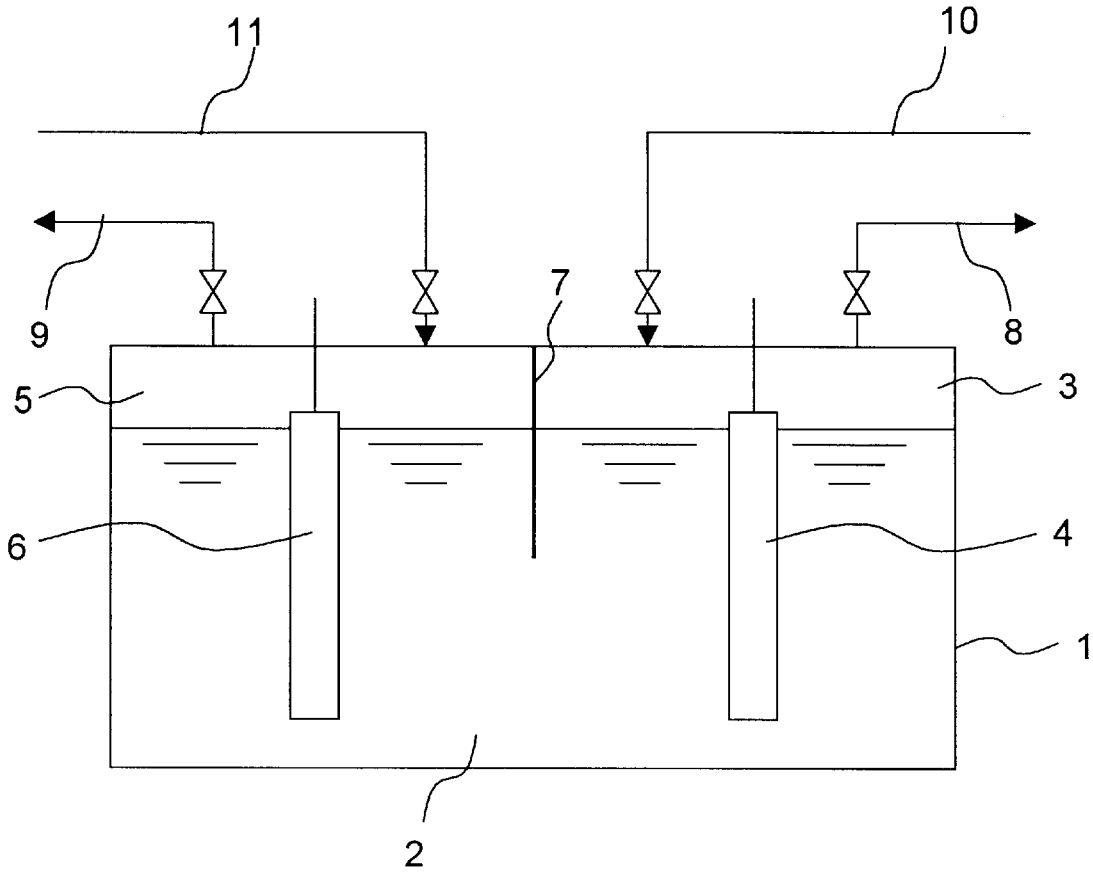
FIG. 2 is a conceptual diagram illustrating an example of an electrolytic cell suitable for the process of this invention.

FIG. 2 is a conceptual diagram illustrating an example of an electrolytic cell suitable for the process of this invention, where ammonium hydrogenfluoride prepared in the material blender is introduced to the electrolytic cell body 1 to prepare an electrolyte 2. Although the electrolyte may be supplied in either a continuous or a batch style, a continuous style is preferable for continuously producing $NF_3$ in a certain rate. On starting electrolysis, $NF_3$ gas is generated on the anode 4 while $H_2$ gas on the cathode 6. These gases may explosively react when being mixed with each other. The electrolytic cell body 1 is, therefore, partitioned into an anode chamber 3 and a cathode chamber 5 by a diaphragm 7. The anode 4 is a nickel electrode as defined above, while the cathode 6 is also a nickel electrode. Although a single pair of anode 4 and cathode 6 is illustrated in this figure, multiple pairs of anode and cathode may be placed in one electrolytic cell, as is industrially common in the light of a production efficiency. Alternatively, there may be placed cathodes in both sides of one anode.

Preferably, the inner surface of the electrolytic cell body 1 is also lined with a fluororesin as is in the material blender. The body 1 is provided with a temperature controlling system (not shown) for heating or cooling to control an electrolyte temperature during molten salt electrolysis. Nickel in the anode may be dissolved into the electrolyte to form a nickel complex salt sludge in the electrolytic cell, leading to frequent replacement of the electrolyte. To solve the problem, the electrolyte may be subject to forced convection or the electrolytic cell body 1 may have such a convection system, as described in JP-A 8-176872.

Molten salt electrolysis can be conducted by applying a direct current to the anode 4 and the cathode 6 in the electrolytic cell body 1 while maintaining the electrolyte temperature within a range of about 110 to 140° C. Electrolytic voltage and current density are preferably 5 to 10 V and 1 to 15 $A/dm^2$, respectively.

For mild electrolysis, an inert gas such as nitrogen, argon and helium gases is introduced as a carrier gas in an appropriate amount into the anode chamber 3 and the cathode chamber 5 via lines 10 and 11, respectively. Preferably, the carrier gas is sufficiently pure to avoid affecting the purity of $NF_3$. Based on our experimental results, the purity of the carrier gas is preferably 4N or higher, most preferably 6N or higher. The carrier gas is preferably nitrogen gas because it is industrially inexpensive and a high purity product is readily available.

$NF_3$ and $H_2$ gases generated on the electrodes are removed, without being mixed, along with a carrier gas via lines 8 and 9, respectively. $NF_3$ gas removed by the line 8 is introduced into a purifier while $H_2$ gas removed by the line 9 is emitted in the air after passing through an appropriate pollutant remover.

The crude gas introduced into the purifier is subject to minor impurity removal to provide high-purity $NF_3$. The crude gas may be purified with a conventional common apparatus such as a scrubber employing a chemical cleaning method and an adsorption tower filled with an adsorbent or a rectification tower.

This invention will be more specifically with reference to, but not limited to, examples.

EXAMPLE 1

$NF_3$ gas was produced by molten salt electrolysis using the flow sheet and the electrolytic cell illustrated in FIGS. 1 and 2, respectively.

First, industrial grade anhydrous hydrofluoric acid (purity: 99.8 wt % or higher) and liquid ammonia (purity: 99.5 wt % or higher) were separately gasified to provide hydrogen fluoride and ammonia gases, respectively. These gases were introduced into a 500 L material blender made of SS-400 whose inner surface was lined with a fluororesin (ETFE), at rates of 2.00 kg/h and 0.71 kg/h, respectively, for reacting with each other under sealing with $N_2$ gas with a purity of 99.9999 vol %, to provide ammonium hydrogenfluoride with an $HF/NH_4$ molar ratio of 1.7.

Then, the ammonium hydrogenfluoride prepared in the blender was continuously introduced into a 450 L electrolytic cell comprising three pairs of electrodes, made of SUS-304 whose inner surface is lined with a fluororesin (PFA), while maintaining the temperature at 122° C. Subsequently, electrolysis was initiated by applying a current of 200 A with a voltage of 7.0 V between the anode and the cathode while introducing $N_2$ gas with a purity of 99.9999 vol % as a carrier gas in the anode chamber at a flow rate of 0.1 L/min. The anode 4 and the cathode 6 were low-carbon Ni (JIS H4551) plates with a purity of 99.0 wt %. The nickel electrodes contained carbon (C) as an impurity in an amount of 350 wt ppm. The electrolysis was continuously conducted for 1000 hours.

The crude gas generated on the anode was taken out via the line 8 and then introduced to a scrubber where chemical cleaning was conducted with water, sodium sulfite and potassium hydroxide, and a purifier consisting of an adsorption tower filled with natural zeolite and a rectifier. At the outlet of the apparatus, a gas meter was placed to determine the amount of the gas produced. The results indicated that the gas was produced at an average rate of 10 to 11 L/min. The purity of the outlet gas was analyzed by on-line gas chromatography. The purity and the carbon compound content for the $NF_3$ gas produced are shown in Table 1.

EXAMPLE 2

Molten salt electrolysis, gas cleaning and gas purification were conducted using the same apparatuses under the same conditions as those in Example 1, except that the carbon (C) level in the low-carbon Ni for the electrodes was 190 wt ppm. The purity and the carbon compound content for the $NF_3$ gas produced are shown in Table 1.

EXAMPLE 3

Molten salt electrolysis, gas cleaning and gas purification were conducted using the same apparatuses under the same conditions as those in Example 1, except that the carbon (C) level in the low-carbon Ni for the electrodes was 90 wt ppm. The purity and the carbon compound content for the $NF_3$ gas produced are shown in Table 1.

Comparative Example 1

Molten salt electrolysis, gas cleaning and gas purification were conducted using the same apparatuses under the same conditions as those in Example 1, except that the nickel purity and the carbon (C) level in the low-carbon Ni for the electrodes were 99.5 wt % and 800 wt ppm, respectively. The purity and the carbon compound content for the $NF_3$ gas produced are shown in Table 1. As seen from the table, the carbon compound content was higher and the $NF_3$ gas purity was less than 4N. Due to lower product purity, the production process was discontinued after about 700 hours.

Referential Example

Molten salt electrolysis, gas cleaning and gas purification were conducted using the same apparatuses under the same conditions as those in Example 1, except that a carbon electrode was used as the anode. The results indicated that the carbon compound content was significantly higher and the NF, gas purity was considerably lower.

TABLE 1

| | Time (h) | Carbon content in an electrode (wt ppm) | Carbon compound level in $NF_3$ (vol. ppm) | $NF_3$ purity (vol %) |
|---|---|---|---|---|
| Ex. 1 | 0–500 | 350 | 8–15 | 99.994–99.991 |
| | 500–1000 | | 8–15 | 99.995–99.9992 |
| Ex. 2 | 0–500 | 190 | 5–10 | 99.994–99.9992 |
| | 500–1000 | | 5–10 | 99.996–99.9992 |
| Ex. 3 | 0–500 | 90 | 1–5 | 99.9991–99.9997 |
| | 500–1000 | | 1–5 | 99.9991–99.9997 |
| Comp. | 0–500 | 800 | 30–50 | 99.91–99.93 |
| Ex. 1 | 500–700 | | 30–50 | 99.91–99.94 |
| Ref. Ex. | — | Carbon electrode | 1200 | 99.7 |

As described above, the process of this invention allows high-purity $NF_3$ gas to be produced with a purity of 4N or higher.

What is claimed is:

1. A process for producing high-purity nitrogen trifluoride gas by molten salt electrolysis using a nickel electrode and ammonium hydrogenfluoride as an electrolyte, wherein carbon (C) constituting impurity gases entrained in a crude gas, among impurities in the nickel electrode as an anode is controlled to an amount of 400 wt ppm or less, wherein the produced high-purity nitrogen trifluoride gas has a purity of 4N (99.99 vol %) or higher.

2. A process for producing high-purity nitrogen trifluoride gas as claimed in claim 1 where the nickel electrode as an anode contains carbon in an amount of 200 wt ppm or less.

3. A process for producing high-purity nitrogen trifluoride gas as claimed in claim 2 where the nickel electrode as an anode contains carbon in an amount of 100 wt ppm or less.

4. A process for producing high-purity nitrogen trifluoride gas as claimed in claim 1 where impurities selected from the group consisting of B, Si, P, As, Mo, Ge and W in the nickel electrode as an anode are controlled to an amount of 400 wt ppm or less in terms of sum with C.

5. A process for producing high-purity nitrogen trifluoride gas as claimed in claim 1 where the nickel electrode has a nickel purity of 98.5 wt % or higher.

6. A process for producing high-purity nitrogen trifluoride gas as claimed in claim 1 where ammonium hydrogenfluoride as an electrolyte has an $HF/NH_4F$ molar ratio of 1.5 to 2.0.

* * * * *